United States Patent [19]

Haines

[11] Patent Number: 4,919,299

[45] Date of Patent: Apr. 24, 1990

[54] CONTAINER ASSEMBLY AND METHOD OF CONSTRUCTING SUCH AN ASSEMBLY

[75] Inventor: Peter R. Haines, Skelmersdale, United Kingdom

[73] Assignee: Lin Pack Mouldings Limited, Birmingham, United Kingdom

[21] Appl. No.: 202,832

[22] Filed: Jun. 3, 1988

[30] Foreign Application Priority Data

Jun. 5, 1987 [GB] United Kingdom ..... 8713252

[51] Int. Cl.[5] ..... B65B 3/00

[52] U.S. Cl. ..... 220/404; 220/307; 220/461

[58] Field of Search ..... 220/403, 404, 453, 461, 220/307

[56] References Cited

U.S. PATENT DOCUMENTS

| | | | |
|---|---|---|---|
| 3,070,275 | 12/1962 | Bostrom | 220/307 X |
| 3,144,167 | 8/1964 | Schultz | 220/404 |
| 4,459,793 | 7/1984 | Zenger | 220/461 X |
| 4,743,479 | 5/1988 | Nakamura et al. | 220/453 X |

*Primary Examiner*—John Fox

[57] ABSTRACT

A container assembly and a method of constructing such an assembly has an outer container (1) a side wall (3) of which forms an open top, and has a blow moulded inner container (7) which forms a liner to the container (1). The liner (7) has a neck (8) which is secured to an internal flnage (4) extending from the outer container. The flange (4) may be moulded integral with either the lener (7) or the outer container (1). A lid (10) has and external annular recess (12) which snap engages with an annular rib (5) on the flange (4) to form a sealed chamber in the assembly. The lid (10) and liner (7) are formed of the same first plastic material (for example PET) while the outer container (1) is formed of a different second plastics material (for example, polypropylene) so that the sealed chamber is defined wholly by the first plastics material which may be expensive but resistance to corrosion from contents (such as paint) stroed in the chamber while the second plastics of the outer container may be inexpensive but non-resistant to corrosion from the contents in the chamber.

7 Claims, 3 Drawing Sheets

CONTAINER ASSEMBLY AND METHOD OF CONSTRUCTING SUCH AN ASSEMBLY

TECHNICAL FIELD & BACKGROUND ART

The present invention relates to a container assembly constructed of plastics materials and primarily intended for containment of liquids such as paint or solvents.

Conventionally liquids such as paints and solvents are stored in metal cans or glass bottles, these however are expensive to form, heavy and in the case of glass bottles, fragile. There is therefore a demand for a lightweight, inexpensive and robust container formed from plastics materials and which is suitable for paints and solvents. However, many plastics materials which are inexpensive and shock resistant, such as polypropylene, and from which a suitable container could be formed, are often corroded or otherwise adversely affected by paints or solvents while suitable plastics materials which are likely to alleviate these effects from paint or solvent are generally regarded as unacceptably expensive.

It is an object of the present invention to provide a container assembly formed of plastics material and a method of constructing such an assembly by which the aforementioned difficulties can be alleviated.

STATEMENT OF INVENTION & ADVANTAGES

According to the present invention there is provided a container assembly comprising an outer open topped container part formed of a first plastics material having a base and an upwardly extending side wall; an open topped inner container part formed of a second plastics material and located and secured to provide a liner within the outer container part, said liner extending within the outer container part downwardly from an internal peripheral flange at the open top of the outer container part, and wherein a removable lid is fitted to said flange to form a seal with the inner container part, said lid having a closure face of the second plastics material whereby the assembly forms a sealed chamber defined by the second plastics material.

Further according to the present invention there is provided a method of constructing a container assembly as specified in the immediately preceding paragraph which comprises moulding the outer container part; moulding a parison for the inner container part and blow moulding said parison to provide the liner for the outer container part; securing said inner container part within said outer container part for the liner to extend downwardly within the outer container part from the internal peripheral flange provided at the open top of the outer container part; moulding the lid to have a closure face of the second plastics material and fitting said lid to the flange to form the sealed chamber.

By the present invention the outer container part is preferably moulded of a relatively inexpensive structural plastics material such as polypropylene to have a shock resistant semi-rigid structure. The inner container part and the lid (or at least the closure face of the lid if that lid is not formed as a one piece moulding) may be formed of a plastics material such as polyethyleneteraphthalates (hereinafter known at PET) which may be regarded as unacceptably expensive to constitute the whole container assembly but has the advantage that it is practically unaffected by chemical or solvent action from a material such as paint, which is likely to be stored in the sealed chamber of the container assembly.

The liner provided by the inner container part is formed by blow moulding a parison, preferably to correspond, substantially, in both size and shape to the interior of the outer container part. Thus the inner container part may comprise substantially less plastics material than the outer container part and when received in the outer container part is supported to prevent liquid received in the inner container part from contacting the outer container part.

In one form of the container assembly the flange is moulded integral with the inner container part to be of the second plastics material, say PET, and is secured to the outer container part with the liner depending from the flange. In this first form of structure the parison for the inner container part may comprise an injection moulded mouth portion and a membrane extending from the mouth portion so that the injection moulded mouth portion corresponds, substantially, to the internal flange and the membrane is blow moulded to provide the liner. Furthermore, the closure face of the lid when fitted may provide a seal directly with the internal flange since both the closure face and the internal flange may be of the same second plastics material. In a further form of the container assembly the flange may be moulded as an integral part of the outer container part so that the liner provided by the inner container part is secured to the flange to extend downwardly therefrom within the outer container part. With the further form of structure the lid is fitted to the flange so that the closure face of the lid forms a seal with the material of the liner/inner container part.

The inner container part may be secured to the outer container part by a compression fit, mechanical engagement (such as snap engagement between appropriately moulded recesses and projections on the respective parts) or bonding by way of adhesive or welding. Usually the inner container part will be secured to the outer container part solely around the internal or external periphery of the internal flange depending upon whether that flange is integral with the outer container part or with the inner container part.

If required support means such as internal ribs in the outer container part can be provided for the liner.

The liner may be blow moulded directly into the outer container part or may be fitted as a moulded unit into the outer container part, possibly through an opening in the bottom of the outer container part which is subsequently closed by a base panel secured to the outer container part.

DRAWINGS

Embodiments of container assemblies constructed in accordance with the present invention will now be described, by way of example only, with reference to the accompanying illustrative drawings in which.

DETAILED DESCRIPTION OF DRAWINGS

Figure 1:
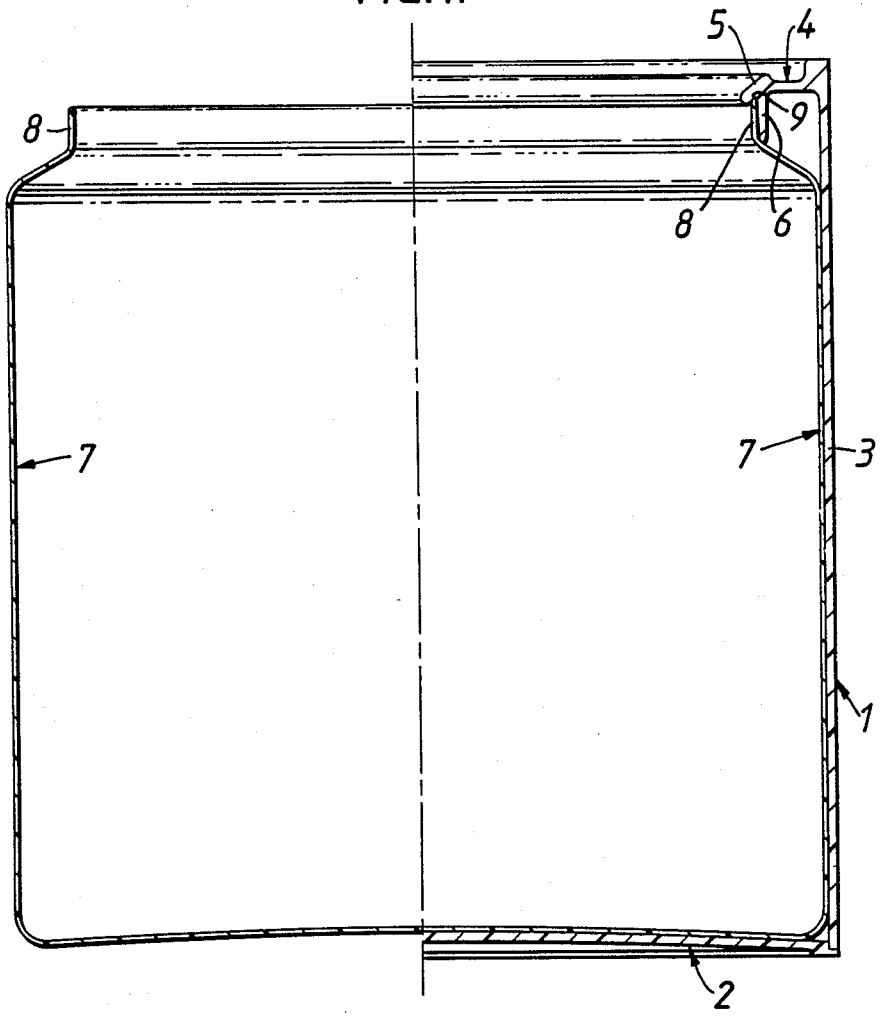
FIG. 1 is a section showing an inner container part and an outer container part (in part only) for a first embodiment of paint container assembly.
Figure 2:
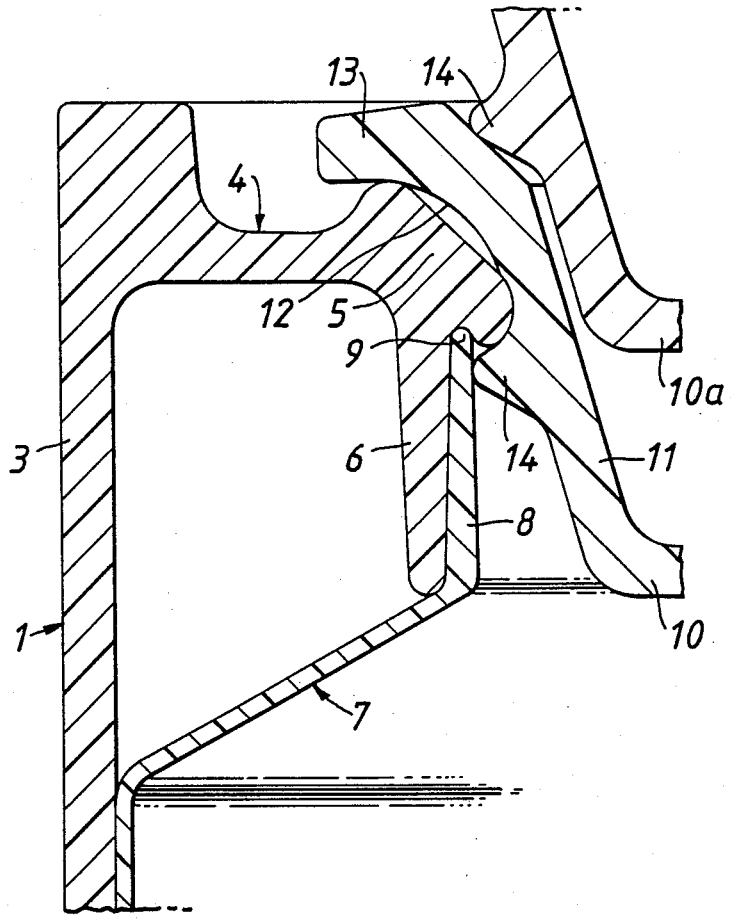
FIG. 2 is a section showing part of the assembly in FIG. 1 with a lid fitted.

The paint container assembly shown in FIGS. 1 and 2 has a generally cylindrical open topped outer container 1 moulded in polypropylene and comprising a base 2 carrying an upwardly extending cylindrical side wall 3. The container part 1 is open topped and the upper end of its side wall 3 is provided with an annular internal flange 4 integrally formed with that side wall. The flange 4 includes an annular rib 5 carrying a downwardly extending cylindrical skirt 6. Located within the outer container part is an open topped inner container part 7 blow moulded in PET to substantially conform to the internal dimensions of the outer container part and which is necked at 8 to be closely received within the skirt 6. For convenience of locating the liner 7, the base 2 is formed as a plate separately from the side wall 1 so that the liner can be inserted into the tube presented by the cylindrical wall 1 and thereafter the base plate 2 is secured to the side wall 1, conveniently by welding. The upper end or rim 9 of the liner neck is closely received within an annular rebate formed between the rib 5 and skirt 6. The liner neck 8 will usually be secured by an adhesive or otherwise to the skirt 6.

For the purpose of closing the open top of the outer container, a dish shaped circular lid 10 is provided which is moulded in PET, advantageously in transparent PET so that the paint colour is discernible through the lid. The lid 10 includes a generally frusto conical side wall 11 having an external annular recess 12 formed between an annular abutment 13 and an external annular rib 14 of the lid. During fitting of the lid to close the assembly, the annular rib 5 snap engages within the annular recess 12. Following such snap engagement the rib 14 of the lid is urged by the resilience of the plastics material to bear against the neck 8 of the liner and thereby form an annular seal between the liner and the lid. The pressure of the rib 14 on the neck 8 additionally serves to retain the liner neck on the skirt 6 of the flange.

Following engagement of the lid with the flange 4 as aforementioned, it will be apparent that a sealed chamber of PET material is defined between the lid 10 and liner 7 so that paint stored within the sealed chamber (and which may be corrosive to inexpensive polypropylene material) is prevented from contacting the polypropylene during storage by the PET barrier. Although PET is more expensive than polypropylene, it is likely to be resistive to corrosive attack from the paint and may represent a much smaller proportion than the polypropylene in the total amount of plastics in the assembly.

It will be seen from the drawings that the annular rib 5 of the flange can conveniently serve for the removal of excess paint from a loaded brush which may be dipped into paint in the container. Although the polypropylene material of the rib 5 will be exposed to paint stored in the container once the lid is removed, it is unlikely that such exposure will be adequate to materially deteriorate the plastics material.

In FIG. 2, there is shown, for convenience (and also in FIG. 3), a second lid 10*a* which is identical to the lid 10, this second lid is illustrated merely to demonstrate the manner in which several lids may be stacked with the rib 14 of an upper lid in abutment with the immediately underlying lid to facilitate removal of the lids successively from the stack.

Figure 3:
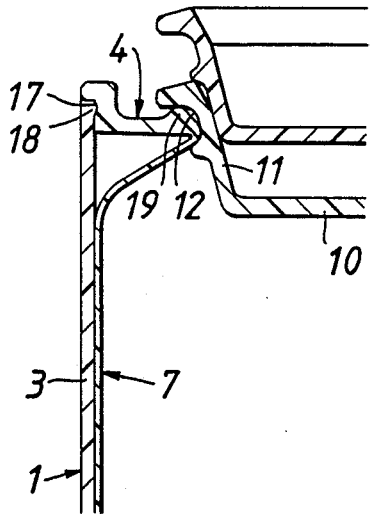
FIG. 3 is a section of a second embodiment of paint container assembly which is shown in part only.
Figure 4:
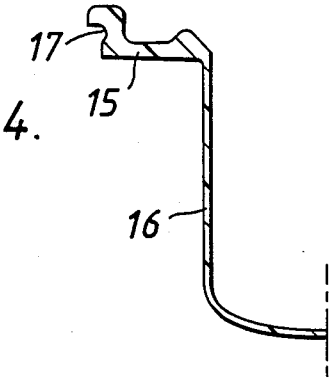
FIG. 4 is a section diagrammatically illustrating a parison from which the inner container part of the assembly shown in FIG. 3 is formed.

In the embodiment shown in FIG. 3 the internal flange 4 for the outer container part 1 is formed of PET and moulded integral with the inner container part 7. FIG. 4 shows (in part only) an injection moulded parison of PET from which the inner container part of FIG. 3 is formed. The parison comprises an annular mouth 15 which is to correspond to the internal flange 4 and which carries on its internal circumferential edge a membrane 16. The membrane 16 is formed into the liner portion of the inner container part 7 by blow moulding so that, in effect, the liner portion is necked as shown in FIG. 3. The outer circumferential edge of the mouth 15 is provided with an annular recess 17 which snap engages, in complementary manner with an internal rib 18 moulded at the upper end of the cylindrical side wall 3. The parison shown in FIG. 4 will usually be blow moulded to the final form of the inner container part 7 prior to its location within the outer container part 3 but if required the blow moulding can take place within the outer container part 3. It will be seen from FIG. 3 that following the blow moulding of the liner portion of the inner container, an internal annular rib 19 is presented by the flange 4 and this rib snap engages within the annular recess 12 of the PET lid 10 to form an annular seal and an enclosed chamber of PET material. The engagement of the recess 17 and rib 18 and the pressure applied therebetween by the resilience of the plastics material when the lid 10 is fitted may be adequate to retain the flange 4 on the outer container part 3 but if necessary the rib 18 can be bonded, for example by adhesive or welding to the flange 4. With this embodiment the base plate 2 of the outer container part can conveniently be formed integral with the cylindrical side wall 1.

Figure 5:
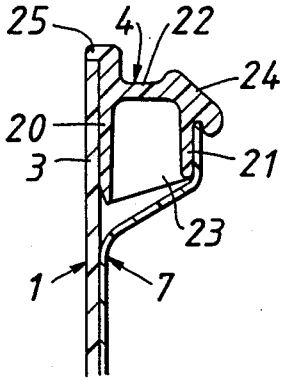
FIG. 5 shows a modified form of inner container part suitable for use in a similar arrangement to that shown in FIG. 3.

The modification shown in FIG. 5 relates primarily to the design of the internal flange for the outer container part 1 when the internal flange is moulded of PET integral with the inner container part 7 in a similar manner to that described with reference to FIG. 3. More particularly in FIG. 5 the inner container part is again formed from an injection moulded PET parison which defines the flange 4 and comprises concentric cylindrical skirts 20 and 21 interconnected by an annular radial web 22 and an array of circumferentially spaced, axially extending reinforcing webs 23. The inner cylindrical skirt 21 is formed as an extension of or continuous with a membrane similar to that shown at 16 in FIG. 4 from which the liner portion of the inner container part is blow moulded as previously discussed. The annular web 22 and cylindrical skirt 21 converge to an internal annular rib 24 which is similar to the rib 5 in FIG. 1 and is intended to snap engage within the annular recess 12 of the PET lid. The outer skirt 20 of the flange 4 in FIG. 5 is provided with an external annular shoulder 25 so that when the inner container part 7 is inserted into a cylindrical wall 3 of the outer container part 1, the shoulder 25 abuts the end of the wall 3 to locate the liner. A close sliding fit of the outer skirt 20 of the flange 4 within the cylindrical wall 3 may be adequate to restrain the inner container in the outer container (particularly when radial pressure is applied to the flange 4 on, fitting the lid 10) but if required the flange 4 of FIG. 5 may be welded or otherwise bonded to the wall 3 or mechanically engaged therewith in a similar manner to that discussed with reference to FIG. 3.

I claim:

1. A container assembly comprising an outer open topped container part formed of a first plastics material having a base and an upwardly extending side wall; an open topped inner container part formed of a second plastics material and located and secured to provide a liner within the outer container part, said liner extending within the outer container part downwardly from an internal peripheral flange at the open top of the outer container part; a removable lid, said lid being fitted to said flange to form a seal with the inner container part, said lid having a closure face of the second plastics material whereby the assembly forms a sealed chamber defined by the second plastics material; said internal flange being provided on the outer container part and being of the first plastics material, said flange comprising a cylindrical skirt which extends downwardly therefrom; said inner container part having a cylindrical neck which is closely received within said cylindrical skirt, and wherein the closure face of the lid is in sealing abutment with the interior of said neck, and said neck of said liner having a rim which is closely received in an annular rebate in said flange.

2. An assembly as claimed in claim 1 in which the lid is a one piece moulding of the second plastics material.

3. An assembly as claimed in claim 1 wherein said internal flange is integrally mounted with the outer container part.

4. An assembly as claimed in claim 1 wherein said cylindrical neck is secured to the cylindrical skirt by welding, bonding or adhesive.

5. An assembly as claimed in claim 1 wherein said side wall of the outer container part extends upwardly from a base and said base comprises a plate of the first plastics material secured to the side wall.

6. An assembly as claimed in claim 1 wherein said flange has an internal annular rib and the lid has an external annular recess with which the annular rib snap engages, said snap engagement providing an annular seal between the plastics of the inner container part and that of the closure face of the lid.

7. An assembly as claimed in claim 1 wherein said second plastics material is PET.

* * * * *